US009233782B2

(12) United States Patent
Ishihara et al.

(10) Patent No.: US 9,233,782 B2
(45) Date of Patent: Jan. 12, 2016

(54) TARGET SUPPLY DEVICE

(71) Applicant: GIGAPHOTON INC, Tochigi (JP)

(72) Inventors: Takanobu Ishihara, Kanagawa (JP); Toshihiro Nishisaka, Kanagawa (JP); Hiroshi Someya, Kanagawa (JP); Osamu Wakabayashi, Tochigi (JP)

(73) Assignee: GIGAPHOTON INC., Tochigi (JP)

( * ) Notice: Subject to any disclaimer, the term of this patent is extended or adjusted under 35 U.S.C. 154(b) by 617 days.

(21) Appl. No.: 13/715,897

(22) Filed: Dec. 14, 2012

(65) Prior Publication Data

US 2013/0240645 A1 Sep. 19, 2013

(30) Foreign Application Priority Data

Mar. 13, 2012 (JP) ..... 2012-056342

(51) Int. Cl.

| | |
|---|---|
| ***B67D 5/54*** | (2006.01) |
| ***B67D 5/40*** | (2006.01) |
| ***B65D 47/06*** | (2006.01) |
| ***H05G 2/00*** | (2006.01) |

(52) U.S. Cl.

CPC ..... *B65D 47/06* (2013.01); *H05G 2/005* (2013.01); *H05G 2/006* (2013.01)

(58) Field of Classification Search

USPC ..... 222/146.1, 148.2, 168, 172, 181.1, 222/181.5, 366, 368, 370, 394, 395, 399, 222/493, 566, 575, 590, 591, 593, 594, 222/596–598, 611.1, 612, 613, 617, 626, 222/628, 631; 238/13, 82, 87, 95, 96, 142, 238/144, 262, 263, 263.1, 273, 280.5, 281, 238/302, 305, 322, 438, 448, 482, 539, 541, 238/590, 602, 651; 250/504 R

See application file for complete search history.

(56) References Cited

U.S. PATENT DOCUMENTS

| | | | | |
|---|---|---|---|---|
| 5,573,148 | A * | 11/1996 | Poole | E01C 23/0973 222/399 |
| 6,119,904 | A * | 9/2000 | Ball | B05B 15/06 222/372 |
| 7,122,816 | B2 | 10/2006 | Algots et al. | |
| 7,378,673 | B2 | 5/2008 | Bykanov et al. | |
| 7,405,416 | B2 | 7/2008 | Algots et al. | |
| 7,449,703 | B2 | 11/2008 | Bykanov | |
| 8,785,895 | B2 * | 7/2014 | Umeda | G03F 7/70033 250/365 |
| 8,921,815 | B2 * | 12/2014 | Umeda | H05G 2/005 250/493.1 |
| 8,927,951 | B2 * | 1/2015 | Umeda | H05G 2/005 250/503.1 |
| 2010/0200776 | A1 | 8/2010 | Yabu et al. | |
| 2014/0008552 | A1 * | 1/2014 | Umeda | G03F 7/70033 250/504 R |
| 2014/0034684 | A1 * | 2/2014 | Ishihara | H05G 2/003 222/399 |
| 2014/0138560 | A1 * | 5/2014 | Umeda | H05G 2/005 250/504 R |
| 2014/0138561 | A1 * | 5/2014 | Umeda | H05G 2/006 250/504 R |

* cited by examiner

*Primary Examiner* — Bernard E Souw

(74) *Attorney, Agent, or Firm* — Studebaker & Brackett PC

(57) ABSTRACT

A target supply device may include a tank formed cylindrically with a first material, a cylindrical portion for covering the tank, the cylindrical portion being formed of a second material having higher tensile strength than the first material, a first lid formed of the second material and having a through-hole, the first lid being provided at one end in an axial direction of the cylindrical portion, a second lid formed of the second material and provided at another end opposite the one end in the axial direction of the cylindrical portion, and a nozzle provided to be in fluid communication with the interior of the tank and to pass through the through-hole, the nozzle being formed of the first material.

6 Claims, 10 Drawing Sheets

TARGET SUPPLY DEVICE

CROSS-REFERENCE TO RELATED APPLICATION

The present application claims priority from Japanese Patent Application No. 2012-056342 filed Mar. 13, 2012.

BACKGROUND

1. Technical Field

The present disclosure relates to target supply devices.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed which combines a system for generating EUV light at a wavelength of approximately 13 nm with a reduced projection reflective optical system.

Three known kinds of systems for generating EUV light include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to one aspect of the present disclosure may include a tank formed cylindrically with a first material, a cylindrical portion for covering the tank, the cylindrical portion being formed of a second material having higher tensile strength than the first material, a first lid formed of the second material and having a through-hole, the first lid being provided at one end in an axial direction of the cylindrical portion, a second lid formed of the second material and provided at another end opposite the one end in the axial direction of the cylindrical portion, and a nozzle provided to be in fluid communication with the interior of the tank and to pass through the through-hole, the nozzle being formed of the first material.

BRIEF DESCRIPTION OF THE DRAWINGS

Hereinafter, selected embodiments of the present disclosure will be described with reference to the accompanying drawings.

DETAILED DESCRIPTION

Figure 1:
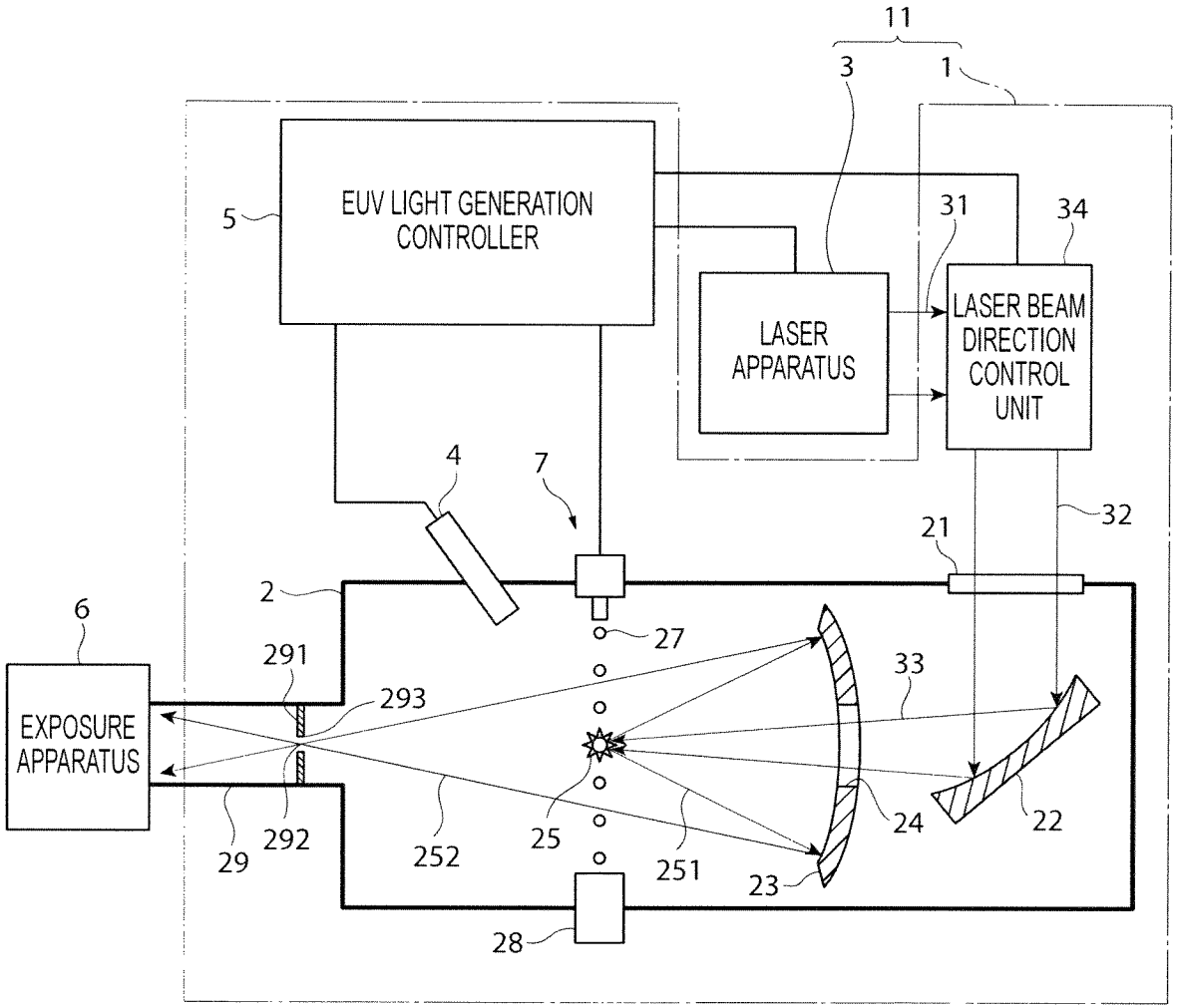
FIG. 1 schematically illustrates a configuration of an exemplary LPP type EUV light generation apparatus.

Hereinafter, selected embodiments of the present disclosure will be described in detail with reference to the accompanying drawings. The embodiments to be described below are merely illustrative in nature and do not limit the scope of the present disclosure. Further, configurations and operations described in each embodiment are not all essential in implementing the present disclosure. Note that like elements are referenced by like reference numerals and characters, and duplicate descriptions thereof will be omitted herein.

Contents

1. Overview
2. Overview of EUV Light Generation System
2.1 Configuration
2.2 Operation
3. EUV Light Generation Apparatus Including Target Supply Device
3.1 First Embodiment
3.1.1 Configuration
3.1.2 Operation
3.2 Second Embodiment
3.2.1 Configuration
3.2.2 Operation
3.3 Third Embodiment
3.3.1 Configuration
3.3.2 Operation
3.4 Fourth Embodiment
3.4.1 Configuration
3.4.2 Operation 1. Overview In an embodiment of the present disclosure, a target supply device may include a tank, a cylindrical portion, a first lid, a second lid, and a nozzle. The tank may be formed of a first material in a cylindrical shape. The cylindrical portion may be formed of a second material having higher tensile strength than the first material to cover the tank. The first lid may be formed of the second material and may have a through-hole formed therein, and the first lid may be provided at one end in the axial direction of the cylindrical portion. The second lid may be formed of the second material, and the second lid may be provided at another end opposite the one end in the axial direction of the cylindrical portion. The nozzle may be formed of the first material and provided to pass through the aforementioned through-hole to be in fluid communication with the interior of the tank.

When the tank and the nozzle are formed of a material that is susceptible to reacting with a target material, the nozzle may be clogged with an alloy produced as the tank and the nozzle react with the target material. Therefore, the tank and the nozzle may be formed of a material that is not susceptible to reacting with the target material. When the target material is tin, materials that are not susceptible to reacting with tin may include molybdenum. Thus, a target generator including the tank and the nozzle may be formed of sintered molybdenum.

When a target material is to be outputted from a target generator, high pressure may be applied inside the target generator. For example, a pressure equal to or higher than 10 Mpa may be applied inside the target generator. When the target generator is formed through sintering, this high pressure may cause the target generator to break. As a result, pieces of the broken target generator may scatter and damage components around the target generator.

According to one or more embodiments of the present disclosure, a target generator may be covered by a cover member that includes a cylindrical portion, a first lid, and a second lid that are formed of a high tensile material. Therefore, even if the target generator breaks due to high pressure, the cover member may be prevented from breaking. Accordingly, pieces of the broken target generator may be prevented from scattering and damaging components around the target generator.

2. Overview of EUV Light Generation System 2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 7. The chamber 2 may be sealed airtight. The target supply device 7 may be mounted onto the chamber 2, for example, to penetrate a wall of the chamber 2. A target material to be supplied by the target supply device 7 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in fluid communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 7 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 31 travels, and the position at which the pulse laser beam 33 is focused. It will be appreciated that the various controls mentioned above are merely examples, and other controls may be added as necessary.

Figure 2:
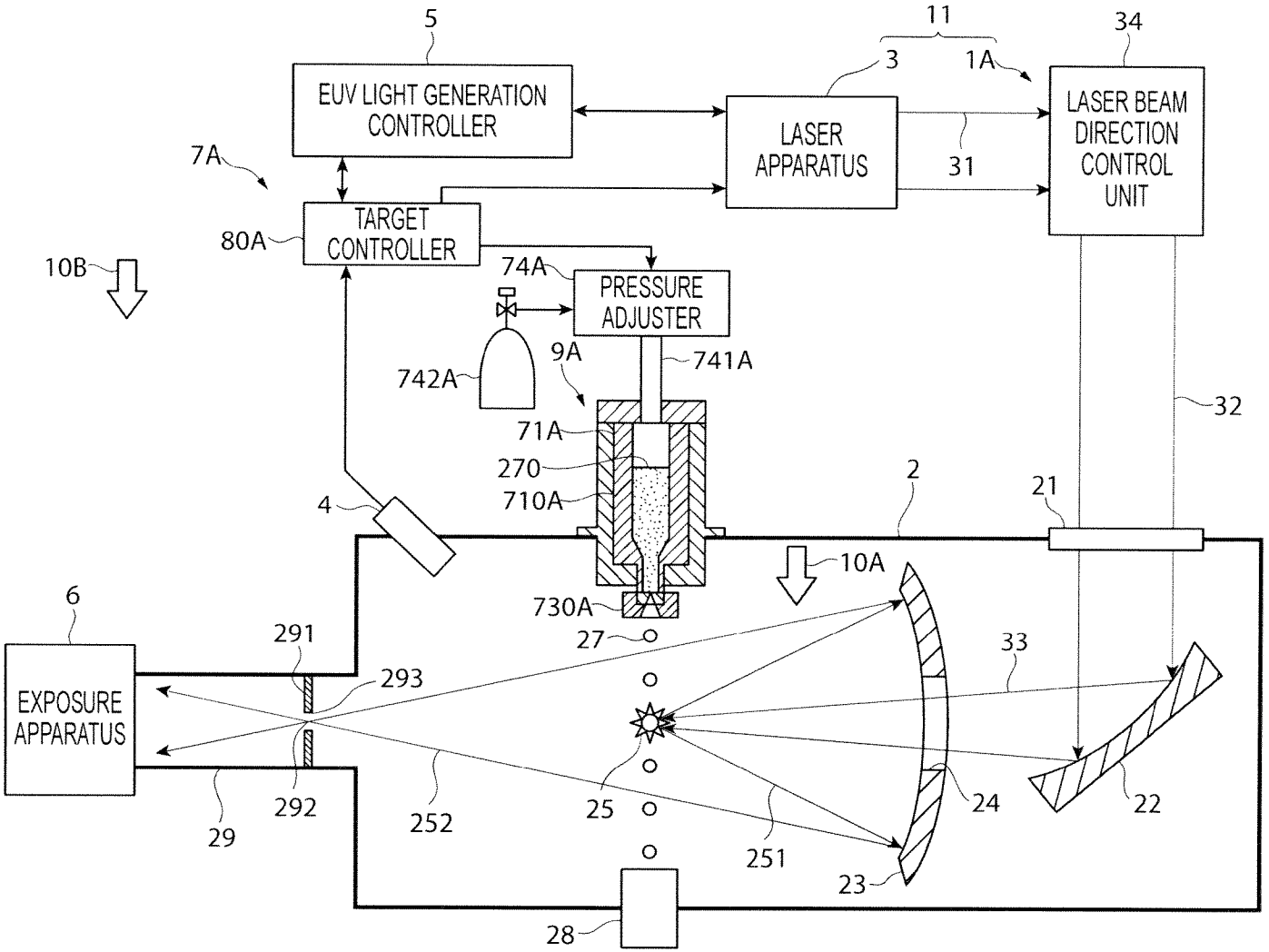
FIG. 2 schematically illustrates an exemplary configuration of an EUV light generation apparatus to which a target supply device according to a first embodiment of the present disclosure is applied.
Figure 3:
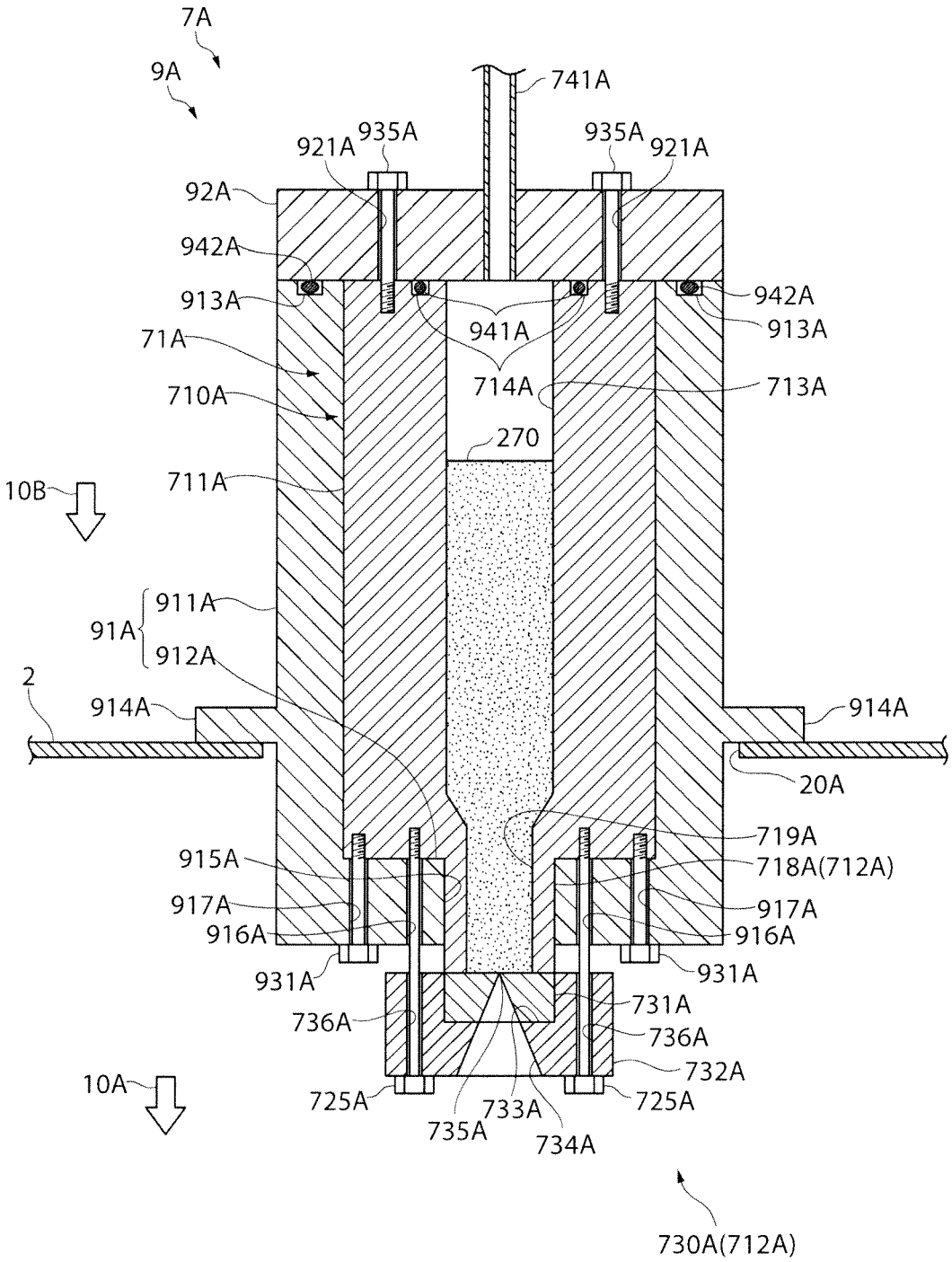
FIG. 3 schematically illustrates an exemplary configuration of a target generator and a cover member according to the first embodiment.
Figure 4:
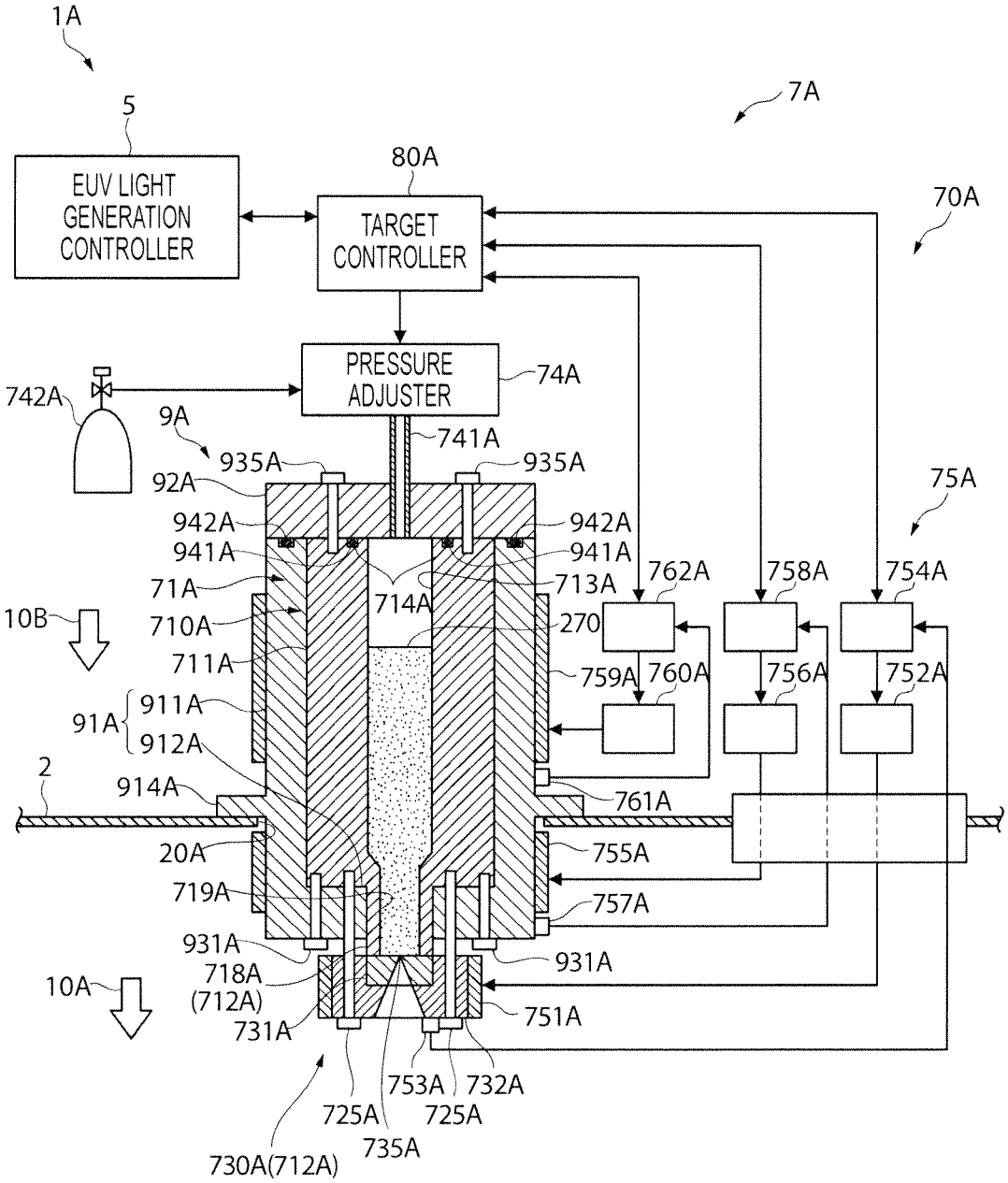
FIG. 4 schematically illustrates an exemplary configuration of a target supply device according to the first embodiment.

3. EUV Light Generation Apparatus Including Target Supply Device 3.1 First Embodiment 3.1.1 Configuration FIG. 2 schematically illustrates an exemplary configuration of an EUV light generation apparatus including a target supply device. FIG. 3 schematically illustrates an exemplary configuration of a target generator and a cover member. FIG. 4 schematically illustrates an exemplary configuration of a target supply device. With reference to FIGS. 2 through 4, an EUV light generation apparatus 1A may include a chamber 2 and a target supply device 7A. The target supply device 7A may include a target generation unit 70A (see FIG. 4) and a target controller 80A. The target generation unit 70A may include a target generator 71A, a cover member 9A, a pressure adjuster 74A, a heating unit 75A, and a piezoelectric push-out unit (not separately shown), as shown in FIG. 4.

The target generator 71A may include a generator body 710A and a nozzle tip 730A. Each of the generator body 710A and the nozzle tip 730A may be formed of a sintered material serving as a first material that is not susceptible to reacting with a liquid target material 270. For example, when tin is used as the liquid target material 270, sintered materials that are not susceptible to reacting with tin may include molybdenum, tungsten, and tantalum.

With reference to FIGS. 3 and 4, the generator body 710A may include a cylindrical tank 711A. The interior of the tank 711A may serve as a space 713A for storing the target material 270 therein. An annular O-ring groove 714A may be formed in the upper surface of the tank 711A. A nozzle body 718A may be provided in the tank 711A at the lower end thereof. The nozzle body 718A may be formed cylindrically to extend in the axial direction of the tank 711A. The interior of the nozzle body 718A may serve as a through-hole 719A through which the target material 270 stored in the space 713A is fed to the nozzle tip 730A. The nozzle body 718A and the nozzle tip 730A may form a nozzle 712A configured such that the through-hole 719A and the space 713A are in fluid communication with each other.

The nozzle tip 730A may include an aperture member 731A and a fixing member 732A. The aperture member 731A may have an outer diameter that is larger than the diameter of the through-hole 719A. The fixing member 732A may have an outer diameter that is larger than the outer diameter of the aperture member 731A. A fitting groove 733A may be formed in the upper surface of the fixing member 732A. The fitting groove 733A may be formed such that the upper surface of the aperture member 731A is flush with the upper surface of the fixing member 732A when the aperture member 731A is fitted into the fitting groove 733A. Further, when the aperture member 731A is fitted into the fitting groove 733A formed in the fixing member 732A, a conical opening 734A may be defined at the center of the nozzle tip 730A to allow the space 713A to be in fluid communication with the exterior of the target generator 71A. The conical opening 734A may be formed such that the diameter thereof increases from the upper surface of the aperture member 731A to the fixing member 732A. The upper end of the conical opening 734A may serve as a nozzle opening 735A. The diameter of the nozzle opening 735A may be in a range from 6 μm to 30 μm inclusive.

The nozzle tip 730A may be fixed to the tank 711A with first bolts 725A each serving as a nozzle tip coupling member. Each of the first bolts 725A may be formed of the same material as the generator body 710A and the nozzle tip 730A. That is, the generator body 710A, the first bolts 725A, and the nozzle tip 730A may be formed of a material having the same expansion rate. Each of the first bolts 725A may be inserted from the lower surface of the fixing member 732A into a bolt insertion hole 736A and another bolt insertion hole 916A formed in a lower end portion 912A serving as a first lid to be screwed into the tank 711A. A space may be formed between the first bolt 725A and the inner surface of the bolt insertion hole 916A. As the first bolts 725A are screwed into the tank 711A as described above, the nozzle tip 730A may be fixed to the tank 711A. Accordingly, the center of the nozzle opening 735A may be positioned on the center axis of the tank 711A, and a face seal may be provided between the aperture member 731A and the nozzle body 718A.

With reference to FIG. 4, the heating unit 75A may include a first heater 751A, a first heater power supply 752A, a first temperature sensor 753A, a first temperature controller 754A, a second heater 755A, a second heater power supply 756A, a second temperature sensor 757A, a second temperature controller 758A, a third heater 759A, a third heater power supply 760A, a third temperature sensor 761A, and a third temperature controller 762A.

The first heater 751A may be provided to heat the aperture member 731A and the fixing member 732A, upon receiving power from the first heater power supply 752A. The first temperature sensor 753A may be provided to detect the temperature of the fixing member 732A as a temperature approximate to the temperature of the aperture member 731A, and send a signal corresponding to a detected temperature to the first temperature controller 754A. The second heater 755A may be provided to heat a cylindrical portion 911A at the lower end side thereof, upon receiving power from the second heater power supply 756A. The second temperature sensor 757A may be provided to detect the temperature of the cylindrical portion 911A at a position located inside the chamber 2 as a temperature approximate to the temperature of the target material 270 in the nozzle body 718A. The second temperature sensor 757A may then send a signal corresponding to a detected temperature to the second temperature controller 758A. The third heater 755A may be provided to heat the cylindrical portion 911A at the upper end side thereof, upon receiving power from the third heater power supply 760A. The third temperature sensor 761A may be provided to detect the temperature of the cylindrical portion 911A at a position located outside the chamber 2 as a temperature approximate to the temperature of the target material 270 in the tank 711A. The third temperature sensor 761A may then send a signal corresponding to a detected temperature to the third temperature controller 762A.

Referring back to FIG. 3, the cover member 9A may include a cover body 91A and a lid member 92A serving as a second lid. The cover body 91A and the lid member 92A may be formed of a high-tensile material serving as a second material having higher tensile strength than the material of the generator body 710A, the first bolts 725A, and the nozzle tip 730A. For example, high-tensile materials having higher tensile strength than molybdenum may include stainless steel (SUS), iron, Inconel®, and Hastelloy®. The cover body 91A and the lid member 92A may be formed of a material having higher thermal expansion rate than the material of the generator body 710A, the first bolts 725A, and the nozzle tip 730A. The cover body 91A and the lid member 92A may be formed of the same material.

The cover body 91A may include the cylindrical portion 911A and the lower end portion 912A formed integrally with the cylindrical portion 911A. An annular O-ring groove 913A may be formed in the upper surface of the cylindrical portion 911A. An attachment portion 914A may be formed along the outer surface of the cylindrical portion 911A. The attachment portion 914A may be provided continuously or discontinuously along the outer surface of the cylindrical portion 911A. An insertion hole 915A may be formed at the center of the lower end portion 912A.

The generator body 710A may be housed in the cover body 91A such that the tank 711A is mounted inside the cylindrical portion 911A and the nozzle body 718A passes through the insertion hole 915A. Here, a face seal may be formed between the cylindrical portion 911A and the tank 711A, the upper surface of the cylindrical portion 911A may be flush with the upper surface of the tank 711A, and a face seal may be formed between the lower end portion 912A and the tank 711A. Further, a face seal may be formed between the insertion hole 915A and the nozzle body 718A, and the nozzle body 718A may project from the lower surface of the lower end portion 912A through the insertion hole 915A. The cover body 91A and the generator body 710A may be fixed with second bolts 931A. The second bolts 931A may be formed of the same material as the cover body 91A and the lid member 92A. Each of the second bolts 931A may be inserted into a bolt insertion hole 917A from the lower side of the lower end portion 912A to be screwed into the tank 711A. The cover body 91A may be fixed to the chamber 2 in a state where the portion of the cover body 91A below the attachment portion 914A is located inside the chamber 2 through an insertion hole 20A formed in the chamber 2.

The lid member 92A may be disc-shaped. The lid member 92A may be provided at the upper end in the axial direction of the cylindrical portion 911A. The lid member 92A may be fixed to the tank 711A with third bolts 935A. The third bolts 935A may be formed of the same material as the cover body 91A and the lid member 92A. Each of the third bolts 935A may be inserted into a bolt insertion hole 921A formed in the lid member 92A from the upper side thereof to be screwed into the tank 711A. A space may be formed between the third bolt 935A and the inner surface of the bolt insertion hole 921A.

A face seal may be formed between the lower surface of the lid member 92A and the upper surfaces of the tank 711A and of the cylindrical portion 911A. An airtight seal may be formed between the generator body 710A and the lid member 92A by fitting a first O-ring 941A in the O-ring groove 714A. Similarly, an airtight seal may be formed between the cylindrical portion 911A and the lid member 92A by fitting a second O-ring 942A in the O-ring groove 913A. The first O-ring 941A may be a metal O-ring. The second O-ring 942A may be a resin O-ring.

Referring back to FIG. 2, an inert gas cylinder 742 may be connected to the pressure adjuster 74A. The pressure adjuster 74A may be connected to the target generator 71A through a pipe 741A provided to penetrate the lid member 92A. The pressure adjuster 74A may be electrically connected to the target controller 80A. The pressure adjuster 74A may control the pressure of the inert gas supplied from the inert gas cylinder 742A to adjust the pressure inside the target generator 71A. The inert gas may be a noble gas such as argon, or nitrogen.

The piezoelectric push-out unit (not separately shown) may include a piezoelectric element (not separately shown) and a piezoelectric element power supply (not separately shown). The piezoelectric element may be provided on the outer surface of the nozzle body 718A inside the chamber 2. In place of the piezoelectric element, a mechanism capable of applying force to the nozzle body 718A at a high speed may be provided. The piezoelectric element power supply may be connected to the piezoelectric element through a feedthrough (not separately shown) provided in the wall of the chamber 2. The piezoelectric element power supply may be connected to the target controller 80A.

Depending on the installation mode of the chamber 2, a pre-set output direction 10A of the target material 270 may not necessarily coincide with a gravitational direction 10B. The target material 270 may be outputted in a direction inclined or perpendicular with respect to the gravitational direction 10B. In the embodiments described herein, the chamber 2 may be installed so that the pre-set output direction 10A coincides with the gravitational direction 10B.

3.1.2 Operation

When EUV light is to be generated, the target generator 71A is heated by the heating unit 75A to a temperature equal to or higher than the melting point of the target material 270. Then, the target controller 80A may send a signal to the pressure adjuster 74A to adjust the pressure inside the target generator 71A to a predetermined pressure. The predetermined pressure may be a pressure at which a meniscus of the target material 270 is formed at the nozzle opening 735A. In this state, a target 27 may not be outputted.

Further, the target controller 80A may carry out the following control to heat the target material 270. The target controller 80A may set target temperatures T1*t*, T2*t*, and T3*t* of the first, second, and third heaters 751A, 755A, and 759A to approximately 370° C., 360° C., and 350° C., respectively.

Then, the target controller 80A may set the target temperatures T1*t*, T2*t*, and T3*t* in the first, second, and third temperature controllers 754A, 758A, and 762A, respectively, to control the temperatures of the first, second, and third heaters 751A, 755A, and 759A. The first, second, and third temperature sensors 753A, 757A, and 761A may detect the temperatures of portions heated by the first, second, and third heaters 751A, 755A, and 759A, respectively. Then, the first, second, and third temperature sensors 753A, 757A, and 761A may send signals corresponding to detected temperatures to the target controller 80A through the first, second, and third temperature controllers 754A, 758A, and 762A, respectively.

The target controller 80A may control the first, second, and third temperature controllers 754A, 758A, and 762A so that temperatures to be detected by the first, second, and third temperature sensors 753A, 757A, and 761A approach the respective target temperatures T1*t*, T2*t*, and T3*t*.

Thereafter, the target controller 80A may send a target generation signal to the piezoelectric element power supply to generate a target 27 on demand. Upon receiving a target generation signal, the piezoelectric element power supply may supply predetermined pulsed power to the piezoelectric element. Upon receiving the power, the piezoelectric element may deform in accordance with the supply timing of the power. Thus, the nozzle body 718A may be pressurized at a high speed, and a target 27 may be outputted. As long as the pressure inside the target generator 71A is retained at a predetermined pressure, a target 27 may be outputted in accordance with the supply timing of the power.

Alternatively, the target controller 80A may be configured to adjust the pressure inside the target generator 71A so that a jet of the target material 270 is generated in a continuous jet method. The pressure inside the target generator 71A in this case may be higher than the aforementioned predetermined pressure. Then, the target controller 80A may send a vibration signal to the piezoelectric element power supply. Upon receiving a vibration signal, the piezoelectric element power supply may supply power to the piezoelectric element to cause the piezoelectric element to vibrate. Upon receiving the power, the piezoelectric element may cause the nozzle 712A to vibrate at a high speed. Thus, the jet of the target material 270 may be divided at a constant cycle into targets 27.

As described above, the target generator 71A may be covered by the cover member 9A formed of a high-tensile material. Thus, even if the target generator 71A is broken due to high pressure applied thereinside, the cover member 9A may be prevented from being broken. Accordingly, pieces of the broken target generator 71A may be prevented from scattering and damaging components around the target generator 71A.

The nozzle tip 730A having the nozzle opening 735A may be configured to be detachable from the nozzle body 718A. Thus, even if oxide of the target material 270 is generated and the nozzle opening 735A is clogged with the oxide, the nozzle tip 730A may simply be replaced as a countermeasure.

The nozzle tip 730A may be attached to the nozzle body 718A with the first bolts 725A. The first bolts 725A may be screwed into the tank 711A through the fixing member 732A. The nozzle tip 730A and the first bolts 725A may be formed of a material having the same expansion rate as the material of the nozzle body 718A. Thus, the first bolts 725A may stay screwed into the tank 711A after the target generator 71A is heated, and a face seal between the nozzle body 718A and the nozzle tip 730A may also be retained. Accordingly, such a disadvantage that the target material 270 leaks through a space between the nozzle body 718A and the nozzle tip 730A may be suppressed.

The target controller 80A may control the first, second, and third heaters 751A, 755A, and 759A so that a temperature gradient is applied to the target material 270 in the axial direction of the tank 711A. Thus, oxide of the target material 270 may be prevented from being deposited in the through-hole 719A of the target generator 71A. Accordingly, the possibility of the oxide clogging the through-hole 719A may be reduced. Thus, a change in the output direction of the targets 27 may be suppressed.

Here, the cylindrical portion 911A and the lower end portion 912A may be formed separately and fixed to each other with bolts or the like. When the cylindrical portion 911A and the lower end portion 912A are formed separately, the cylindrical portion 911A and the lid member 92A may be integrally formed. The nozzle tip 730A may be fixed to the tank 711A through press-fitting or engagement. These modifications may also be adopted in the embodiments to be described below.

3.2 Second Embodiment 3.2.1 Configuration

Figure 5A:
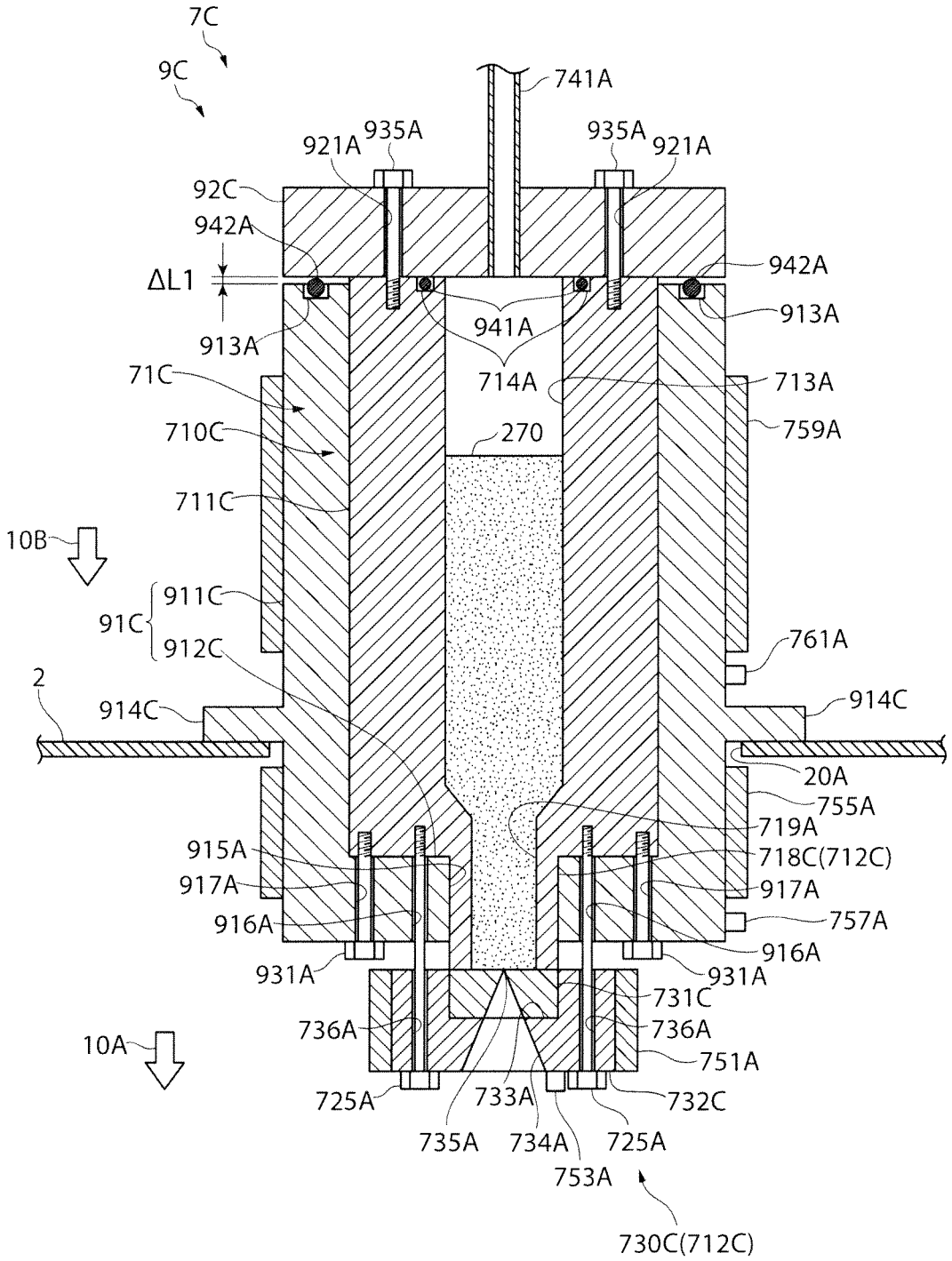
FIG. 5A schematically illustrates an exemplary configuration of a target generator and a cover member according to a second embodiment of the present disclosure in a state in which the target generator and the cover member are not heated.
Figure 5B:
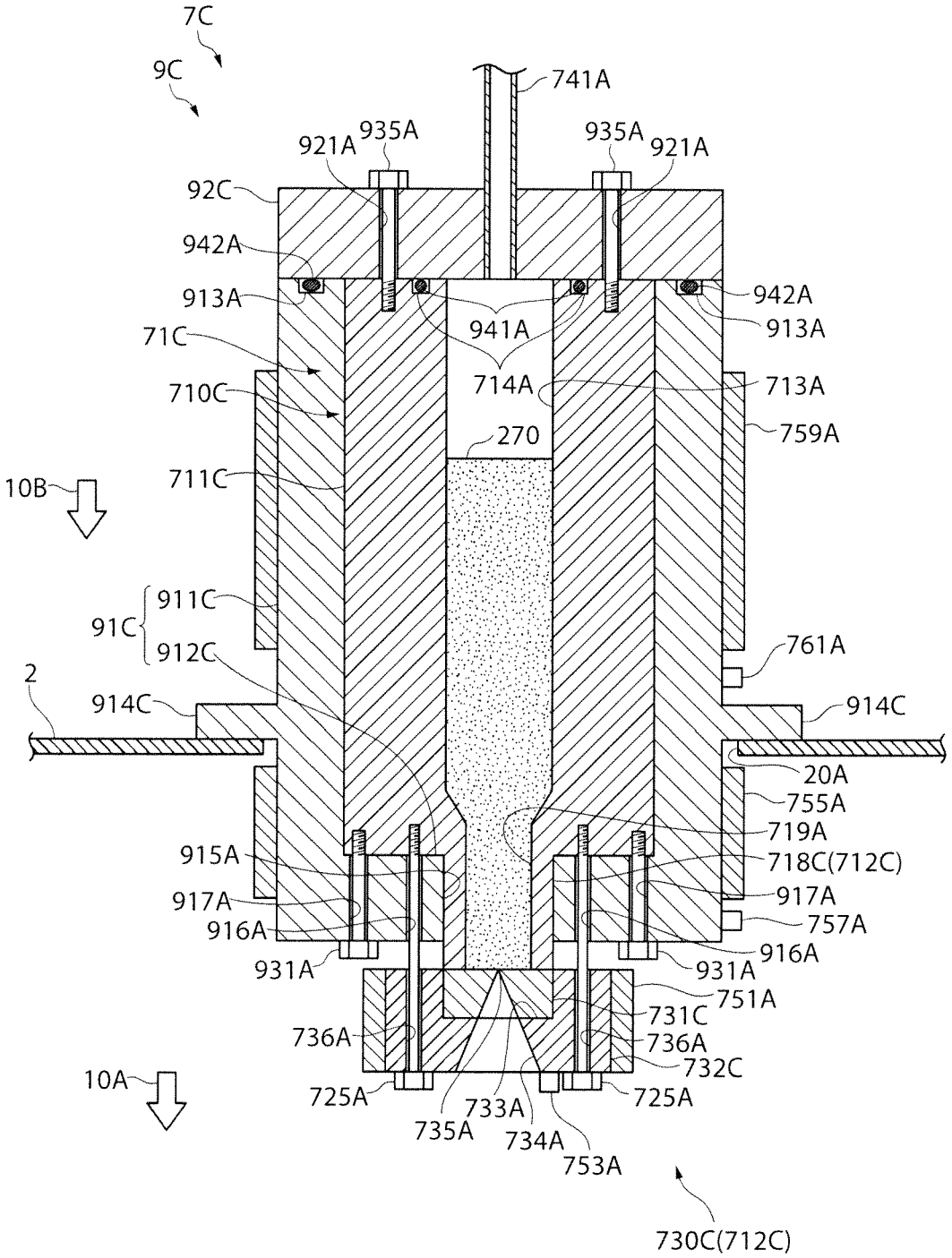
FIG. 5B shows the target generator and the cover member shown in FIG. 5A in a state in which the target generator and the cover member are heated to a temperature equal to or higher than the melting point of a target material.

FIG. 5A schematically illustrates an exemplary configuration of a target generator and a cover member according to a second embodiment of the present disclosure in a state in which the target generator and the cover member are not heated. FIG. 5B shows the target generator and the cover member shown in FIG. 5A in a state in which the target generator and the cover member are heated to a temperature equal to or higher than the melting point of a target material.

In the second embodiment, since configurations of components aside from the target generator and the cover member may be similar to those in the first embodiment, the target generator and the cover member will be described in detail below. As shown in FIG. 5A, a target supply device 7C may include a target generator 71C, and the target generator 71C may include a generator body 710C and a nozzle tip 730C. The generator body 710C and the nozzle tip 730C may be formed of molybdenum that is not susceptible to reacting with tin used as the target material 270. The generator body 710C may include a cylindrical tank 711C and a cylindrical nozzle body 718C extending downwardly from the lower surface of the tank 711C. The nozzle body 718C may include the through-hole 719A. The nozzle body 718C and the nozzle tip 730C may constitute a nozzle 712C. The nozzle tip 730C may include an aperture member 731C and a fixing member 732C. The aperture member 731C and the fixing member 732C may be formed of molybdenum and fixed to the tank 711C with the first bolts 725A.

A cover member 9C may include a cover body 91C and a lid member 92C serving as a second lid. The cover body 91C and the lid member 92C may be formed of stainless steel having higher tensile strength than the material of the generator body 710C, the first bolts 725A, and the nozzle tip 730C. The cover body 91C may include a cylindrical portion 911C and a lower end portion 912C serving as a first lid provided at the lower end in the axial direction of the cylindrical portion 911C. An attachment portion 914C may be provided on the outer surface of the cylindrical portion 911C.

A thermal expansion coefficient of molybdenum forming the target generator 71C may be approximately $5.4\times10^{-6}$ in a range from 20° C. to 370° C. inclusive. A thermal expansion coefficient of stainless steel forming the cover member 9C may be approximately $17.5\times10^{-6}$ in a range from 20° C. to 370° C. inclusive. For example, when the height of the target generator 71C defined as a distance from the lower surface to the upper surface thereof and the height of the space inside the cover member 9C defined as a distance from the upper surface of the lower end portion 912C to the lower surface of the lid member 92C are both 100 mm, if the temperature of the target generator 71C and the cover member 9C rises from 20° C. to 370° C., the target generator 71C and the cover member 9C may expand. Here, since the thermal expansion coefficient of the cover member 9C is greater than the thermal expansion coefficient of the target generator 71C, at 370° C., the height of the cover member 93C defined as a distance from the upper surface of the lower end portion 912C to the upper surface of the cylindrical portion 911C may increase more than the height of the target generator 71C by approximately 0.423 mm.

Therefore, the target generator 71C and the cover member 9C may be formed such that the target generator 71C is housed in the cover member 9C as described below at 20° C. The generator body 710C may be housed in the cover body 91C such that the tank 711C is mounted in the cylindrical portion 911C and the nozzle body 7180 passes through the insertion hole 915A. Here, the upper surface of the cylindrical portion 911C may be located below the upper surface of the tank 711C by a distance ΔL1. The distance ΔL1 may be approximately 0.423 mm. A face seal may be formed between the insertion hole 915A and the nozzle body 718C, and the nozzle body 718C may project from the lower surface of the lower end portion 912C. The cover body 91C and the generator body 710C may be fixed to each other with second bolts 931A.

The lid member 92C may be fixed to the tank 711C with the third bolts 935A. Here, a face seal may be formed between the lid member 92C and the tank 711C with the first O-ring 941A fitted in the O-ring groove 714A. Meanwhile, a space having the distance ΔL1 may be formed between the upper surface of the cylindrical portion 911C and the lower surface of the lid member 92C. Further, the second O-ring 942A fitted in the O-ring groove 913A may or may not be in contact with the lid member 92C.

3.2.2 Operation

With reference to FIG. 5A, the target controller 80A (see FIG. 4) may first set the target temperatures T1*t*, T2*t*, and T3*t* of the first, second, and third heaters 751A, 755A, and 759A to 370° C., 360° C., and 350° C., respectively, in a state where the target generator 71C and the cover member 9C are not yet heated. Through this setting, a temperature distribution may be applied in the axial direction to the target material 270 inside the heated target generator 71C. Here, upon being heated, the target generator 71C and the cover member 9C may expand. Further, while the lower end portion 912C may be fixed to the tank 711C, the cylindrical portion 911C may not be fixed to either of the tank 711C or the lid member 92C. Here, due to a difference in the thermal expansion coefficients as described above, an amount by which the height of the cover member 9C increases may be greater than an amount by which the height of the target generator 71C increases by the distance ΔL1. Accordingly, as shown in FIG. 5B, the upper surface of the cylindrical portion 911C may come into contact with the lower surface of the cover body 91C to form a face seal therebetween, and may also be sealed by the second O-ring 942A.

As described above, the cover member 9C may be formed of a material having a higher expansion rate than the material of the target generator 71C. The lid member 92C may be fixed to the tank 711C. The lower end portion 912C may be fixed to the tank 711C such that the cylindrical portion 911C makes contact with the lid member 92C when the cover member 9C is heated to a temperature equal to or higher than the melting point of the target material 270 such as 370° C. and a space is generated between the cylindrical portion 911C and the lid member 92C when the cover member 9C is not heated. Thus, when the target generator 71C and the cover member 9C are heated to a predetermined temperature that is equal to or higher than the melting point of the target material 270, the cylindrical portion 911C may expand to come into contact with the lid member 92C.

3.3 Third Embodiment 3.3.1 Configuration

Figure 6A:
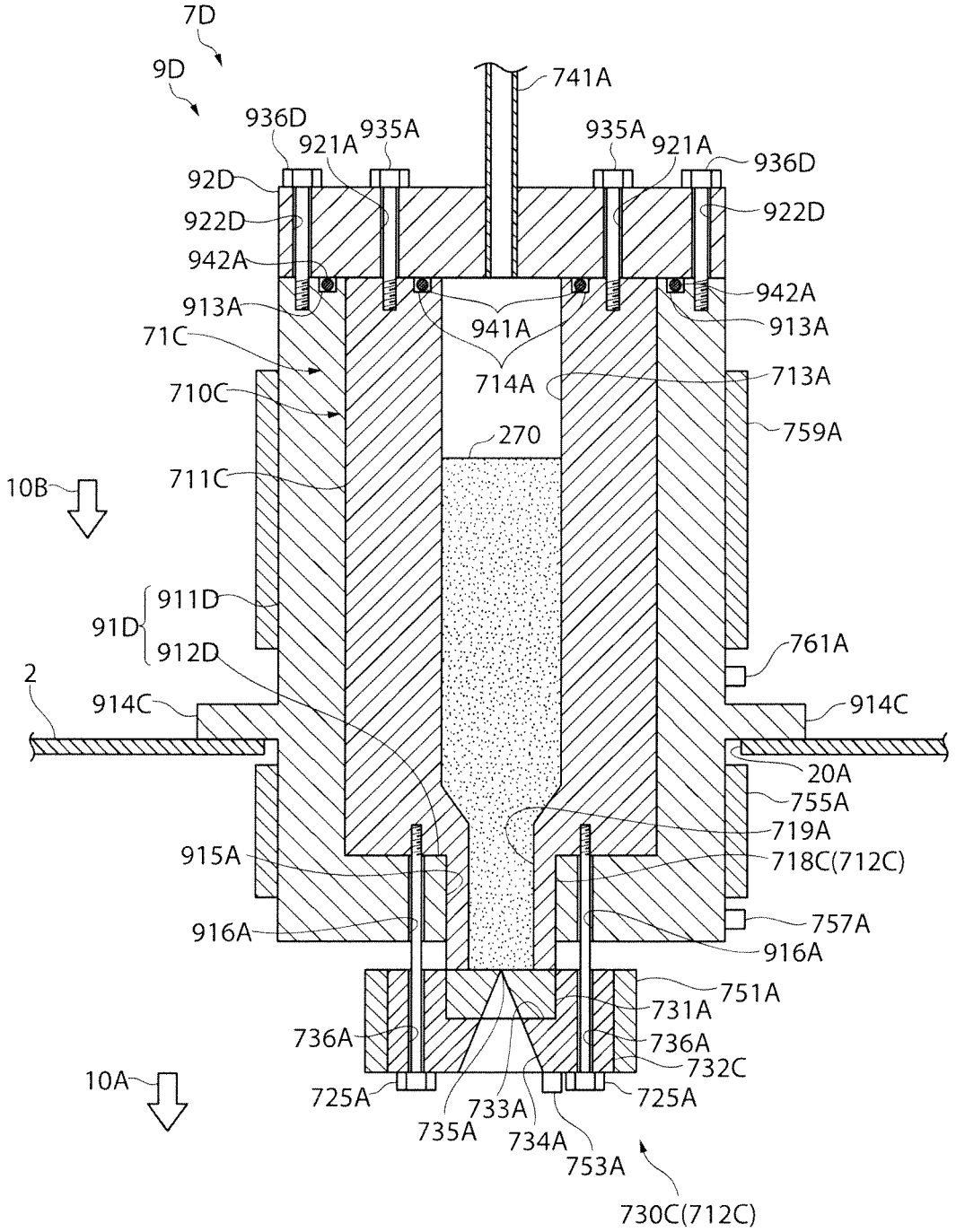
FIG. 6A schematically illustrates an exemplary configuration of a target generator and a cover member according to a third embodiment of the present disclosure in a state in which the target generator and the cover member are not heated.
Figure 6B:
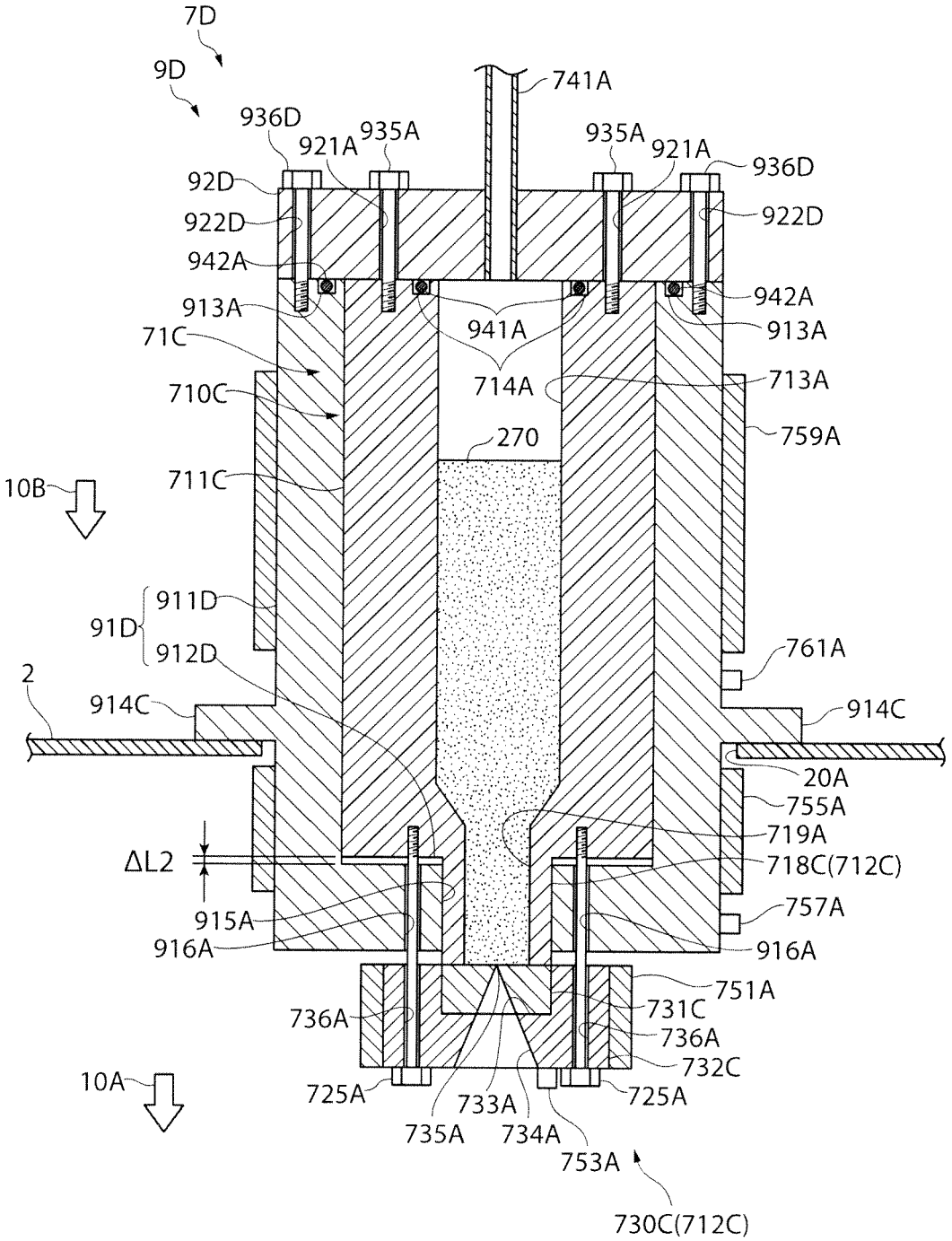
FIG. 6B shows the target generator and the cover member shown in FIG. 6A in a state in which the target generator and the cover member are heated to a temperature equal to or higher than the melting point of a target material.

FIG. 6A schematically illustrates an exemplary configuration of a target generator and a cover member according to a third embodiment of the present disclosure in a state in which the target generator and the cover member are not heated. FIG. 6B shows the target generator and the cover member shown in FIG. 6A in a state in which the target generator and the cover member are heated to a temperature equal to or higher than the melting point of a target material.

In the third embodiment, the configuration of components other than the cover member is similar to that of the second embodiment, and thus the cover member will be described in detail below. A cover member 9D of a target supply device 7D may include a cover body 91D and a lid member 92D serving as a second lid. The cover body 91D and the lid member 92D may be formed of stainless steel. The cover body 91D may include a cylindrical portion 911D and a lower end portion 912D serving as a first lid. The lower end portion 912D may include the bolt insertion holes 916A. Thus, the bolt insertion holes 917A shown in FIGS. 3, 5A, and 5B need not be formed. The lid member 92D may include bolt insertion holes 922D formed toward the periphery of the lid member 92D.

As stated above, molybdenum serving as a material of the target generator 71C and stainless steel serving as a material of the cover member 9D have different thermal expansion coefficients. Thus, when the temperature of the target generator 71C and the cover member 92D rises from 20° C. to 370° C., the height of the space inside the cover member 9D may become greater than the height of the target generator 71C by approximately 0.423 mm.

Accordingly, the nozzle tip 730C may be fixed to the target generator 71C such that a space is generated between the fixing member 732C and the lower end portion 912D when the target generator 71C and the cover member 92D are heated to 370° C. as shown in FIG. 6B. The generator body 710C may be housed in the cover body 91D such that the tank 711C is mounted in the cylindrical portion 911D and the nozzle body 718C passes through the insertion hole 915A in a state where the target generator 71C and the cover member 9D are not heated. A face seal may be formed between the insertion hole 915A and the nozzle body 718C, and the nozzle body 718C may project from the lower surface of the lower end portion 912D. Further, a face seal may be formed between the tank 711C and the lower end portion 912D.

Further, the cylindrical portion 911D may be configured to be slidable with respect to the tank 711C. For example, each of the tank 711C and the cylindrical portion 911D may be formed such that a difference between the outer diameter of the tank 711C and the inner diameter of the cylindrical portion 911D falls within a range from 10 μm to 70 μm inclusive. Further, at least one of the outer surface of the tank 711C and the inner surface of the cylindrical portion 911D may be processed such that the surface roughness thereof is equal to less than 3.2 μm. The lid member 92D may be fixed to the tank 711C with the third bolts 935A. Here, a face seal may be formed between the lid member 92C and the tank 711C with the first O-ring 941A. Further, the lid member 92D may be fixed to the cylindrical portion 911D with fourth bolts 936D inserted into the respective bolt insertion holes 922D. A space may be formed between the fourth bolt 936D and the inner surface of the bolt insertion hole 922D. Here, a face seal may be formed between the lid member 92D and the cylindrical portion 911D with the second O-ring 942A. The nozzle tip 730C may be fixed to the tank 711C with the first bolts 725A inserted into the bolt insertion holes 736A and the bolt insertion holes 916A.

3.3.2 Operation

With reference to FIG. 6A, the target controller 80A (see FIG. 4) may first set the target temperatures T1*t*, T2*t*, and T3*t* of the first, second, and third heaters 751A, 755A, and 759A to 370° C., 360° C., and 350° C., respectively, in a state where the target generator 71C and the cover member 9D are not heated. Here, the cylindrical member 911D may be fixed to the lid member 92D, and the lower end portion 912D may not be fixed to the tank 711C. Thus, due to a difference in the thermal expansion coefficients as described above, an amount by which the height of the space inside the cover member 9D increases may be greater than an amount by which the height of the target generator 71C increases by a distance ΔL2. Accordingly, as shown in FIG. 6B, the lower end portion 912D may be separated from the tank 711C, and thus a space may be formed between the lower end portion 912D and the tank 711C.

As described above, the cover member 9D may be formed of a material having a higher expansion rate than the material of the target generator 71C. The lid member 92D may be fixed to the tank 711C. The cylindrical portion 911D may be fixed to the lid member 92D such that a space is secured between the lower end portion 912D and the nozzle tip 730C even when the cover member 9D is heated to a temperature equal to or higher than the melting point of the target material 270 such as 370° C. Thus, even when the target generator 71C and the cover member 9D are heated to a predetermined temperature that is equal to or higher than the melting point of the target material 270 and the cylindrical portion 911C expands, a state where a space is secured between the lower end portion 912D and the nozzle tip 730C may be retained. Thus, the nozzle tip 730C may be prevented from being biased in a direction away from the nozzle body 718C by the lower end portion 912D. Accordingly, a disadvantage that the target material 270 leaks through a space between the nozzle tip 730C and the nozzle body 718C may be suppressed.

The cylindrical portion 911D is configured to be slidable with respect to the tank 711C. Accordingly, the tank 711C may be prevented from being damaged when the cylindrical portion 911D expands.

3.4 Fourth Embodiment 3.4.1 Configuration

Figure 7A:
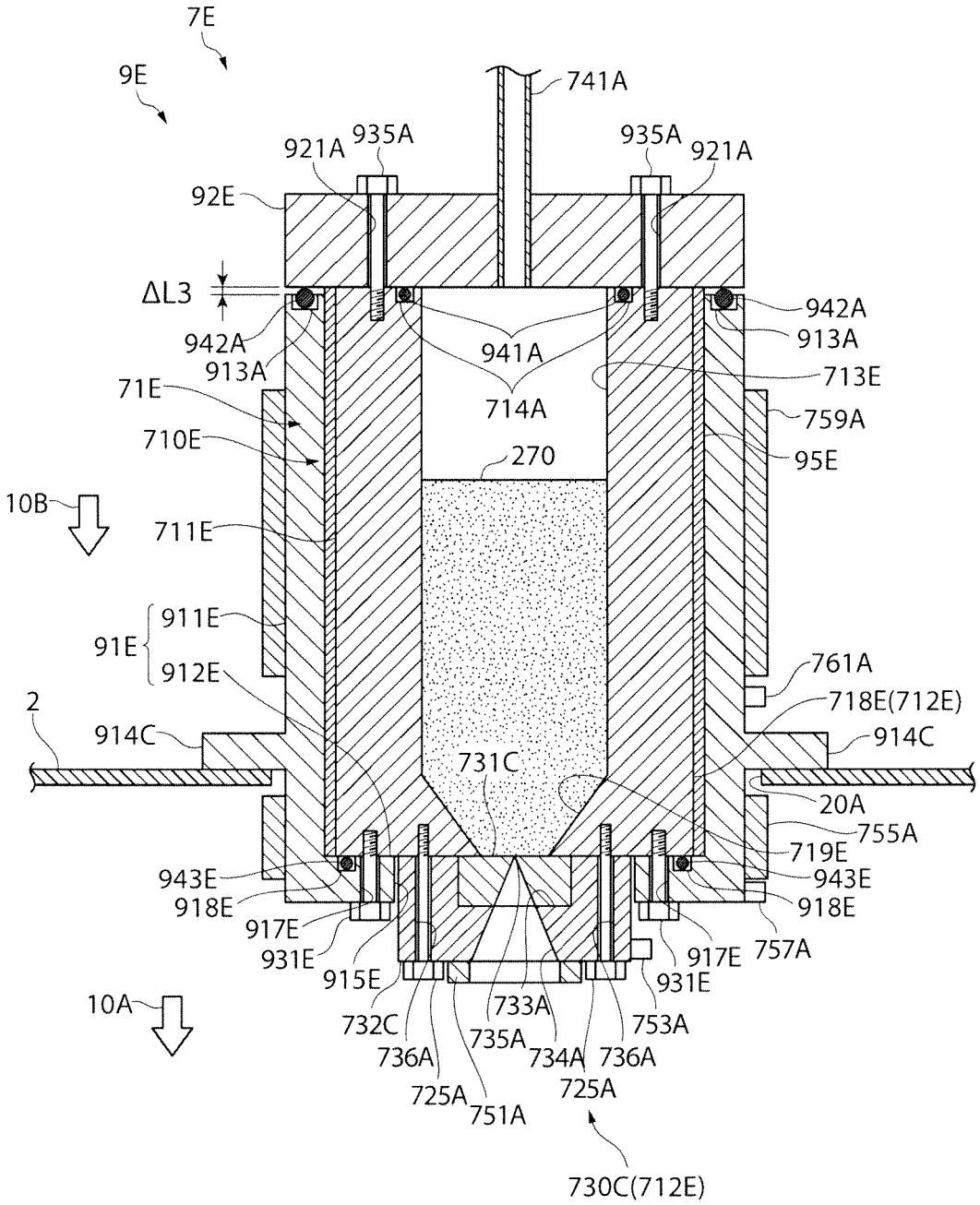
FIG. 7A schematically illustrates an exemplary configuration of a target generator and a cover member according to a fourth embodiment of the present disclosure in a state in which the target generator and the cover member are not heated.
Figure 7B:
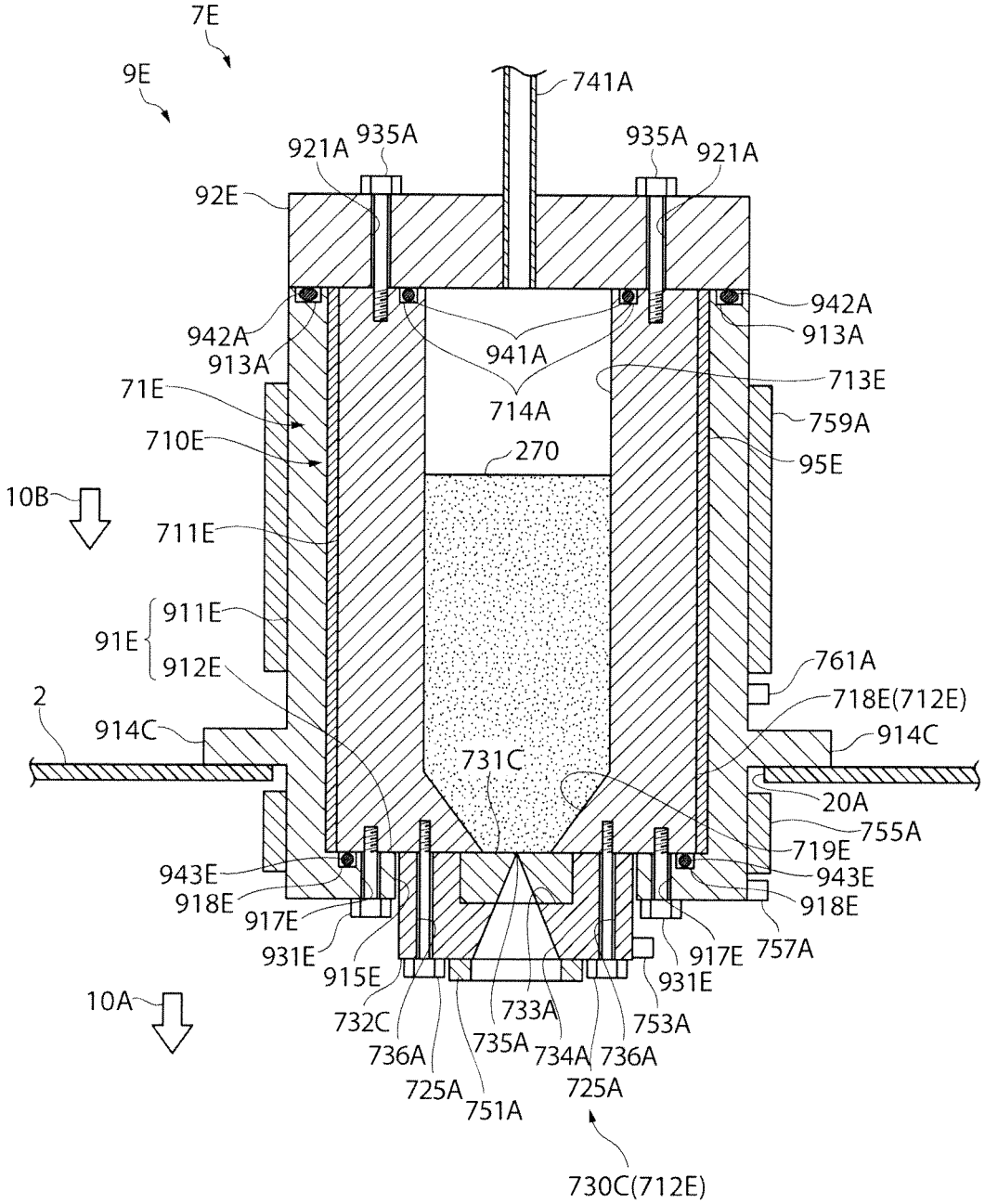
FIG. 7B shows the target generator and the cover member shown in FIG. 7A in a state in which the target generator and the cover member are heated to a temperature equal to or higher than the melting point of a target material.

FIG. 7A schematically illustrates an exemplary configuration of a target generator and a cover member according to a fourth embodiment of the present disclosure in a state in which the target generator and the cover member are not heated. FIG. 7B shows the target generator and the cover member shown in FIG. 7A in a state in which the target generator and the cover member are heated to a temperature equal to or higher than the melting point of a target material.

In the fourth embodiment, configurations of components aside from the target generator and the cover member may be similar to those of the first embodiment, and thus the target generator and the cover member will be described in detail below.

With reference to FIG. 7A, a target generator 71E of a target supply device 7E may include a generator body 710E and the nozzle tip 730C. The generator body 710E may be formed of molybdenum and have a cylindrical shape. The lower end portion of the generator body 710E in the axial direction may constitute a nozzle body 718E whose inner diameter gradually increases from the lower end toward the upper side. The interior of the nozzle body 718E may serve as a through-hole 719E. A portion of the generator body 710E above the nozzle body 718E may constitute a tank 711E having a constant inner diameter in the axial direction. The interior of the tank 711E may serve as a space 713E. The nozzle tip 730C may be fixed to the generator body 710E with the first bolts 725A such that a face seal is formed between the aperture member 731C and the lower surface of the generator body 710E. The nozzle body 718E and the nozzle tip 730C may form a nozzle 712E arranged such that the through-hole 719E and the space 713E are in fluid communication with each other.

The cover member 9E may include a cover body 91E and a lid member 92E serving as a second lid. The cover body 91E and the lid member 92E may be formed of stainless steel. The cover body 91E may include a cylindrical portion 911E and a lower end portion 912E serving as a first lid. An insertion hole 915E may be formed at the center of the lower end portion 912E. The inner diameter of the insertion hole 915E may be slightly larger than the outer diameter of the fixing member 732C. Bolt insertion holes 917E may be formed in the lower end portion 912E to surround the insertion hole 915E. An annular O-ring groove 918E may be formed to surround the bolt insertion holes 917E.

As stated above, molybdenum, which forms the target generator 71E and stainless steel, which forms the cover member 9E, have different thermal expansion coefficients. Thus, when the temperature rises from 20° C. to 370° C., the height of the cover member 9E may increase more than the height of the target generator 71E by approximately 0.423 mm.

Accordingly, as shown in FIG. 7A, each of the target generator 71E and the cover member 9E may be formed such that the target generator 71E is housed in the cover member 9E as follows at 20° C. The generator body 710E may be housed in the cover body 91E such that the tank 711E is mounted in the cylindrical portion 911E and the nozzle tip 730C passes through the insertion hole 915E. Here, a space may be formed between the outer surface of the generator body 710E and the inner surface of the cylindrical portion 911E. Further, the upper surface of the cylindrical portion 911E may be located below the upper surface of the tank 711E by a distance ΔL3. The distance ΔL3 may be approximately 0.423 mm. The cover body 91E and the generator body 710E may be fixed to each other with second bolts 931E inserted into the bolt insertion holes 917E. Further, a face seal may be formed between a region of the lower end portion 912E toward the periphery from the bolt insertion holes 917E and the lower surface of the generator body 710E with a third O-ring 943E fitted in the O-ring groove 918E.

The lid member 92E may be fixed to the tank 711E with the third bolts 935A. Here, a face seal may be formed between the lid member 92E and the tank 711E with the first O-ring 941A. Meanwhile, a space having the distance ΔL3 may be formed between the upper surface of the cylindrical portion 911E and the lower surface of the lid member 92E. Further, the second O-ring 942A may provide a seal between the cylindrical portion 911E and the lid member 92E.

A thermally conductive member 95E may be provided between the outer surface of the generator body 710E and the inner surface of the cylindrical portion 911E. The thermally conductive member 95E may, for example, be a thermally conductive grease containing a copper oxide.

3.4.2 Operation

With reference to FIG. 7A, the target controller 80A (see FIG. 4) may first set the target temperatures T1*t*, T2*t*, and T3*t* of the first, second, and third heaters 751A, 755A, and 759A to 370° C., 360° C., and 350° C., respectively, in a state where the target generator 71E and the cover member 9E are not heated. Here, the lower end portion 912E may be fixed to the generator body 710E, and the cylindrical portion 911E may not be fixed to either of the generator body 710E or the lid member 92E. Thus, an amount by which the height of the cylindrical member 911E increases may be greater than an amount by which the height of the target generator 71E increases by the distance ΔL3. Accordingly, as shown in FIG. 7B, the upper surface of the cylindrical portion 911E may come into contact with the lower surface of the cover body 91E to form a face seal therebetween, and may also be sealed by the second O-ring 942A.

As described above, the thermally conductive member 95E may be provided between the outer surface of the generator body 710E and the inner surface of the cylindrical portion 911E. Accordingly, even when the second and third heaters 755A and 759A are provided on the outer surface of the cover member 9E, the interior of the target generator 71E may be heated efficiently through the thermally conductive member 95E.

The first O-ring 941A may provide a seal between the upper surface of the generator body 710E and the lower surface of the lid member 92E. The second O-ring 942A may provide a seal between the upper surface of the cylindrical portion 911E and the lower surface of the lid member 92E. Further, the third O-ring 943E may provide a seal between a region of the lower end portion 912E toward the periphery from the bolt insertion holes 917E and the lower surface of the generator body 710E. Thus, even if gas is generated from the thermally conductive grease serving as the thermally conductive member 95E, the gas may be prevented from leaking to the exterior of the cover member 9E or into the space 713E.

Since the thermally conductive grease is used as the thermally conductive member 95E, even if the cylindrical portion 911E moves with respect to the generator body 710E due to thermal expansion, the cylindrical portion 911E and the generator body 710E may be prevented from being damaged or broken.

A copper thin film or tin may be used as the thermally conductive member 95E. When tin is used, tin is solid at 20° C. but may melt at 370° C. Even when tin is molten, the first, second, and third O-rings 941A, 942A, and 943E may prevent tin from leaking to the exterior of the cover member 9E or into the space 713E.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply device, comprising:

a tank formed cylindrically with a first material;

a cylindrical portion for covering the tank, the cylindrical portion being formed of a second material having higher tensile strength than the first material;

a first lid formed of the second material and having a through-hole, the first lid being provided at one end in an axial direction of the cylindrical portion;

a second lid formed of the second material and provided at another end opposite the one end in the axial direction of the cylindrical portion; and a nozzle provided to be in fluid communication with the interior of the tank and to pass through the through-hole, the nozzle being formed of the first material.

2. The target supply device according to claim 1, wherein:

an expansion rate of the second material is greater than an expansion rate of the first material, the cylindrical portion is fixed to the first lid, the second lid is fixed to the tank, and the first lid is fixed to the tank such that the cylindrical portion is in contact with the second lid when each of a temperature of the cylindrical portion, a temperature of the first lid, and a temperature of the second lid is at a predetermined temperature that is equal to or higher than a melting point of a target material, and such that a space is present between the cylindrical portion and the second lid when each of a temperature of the cylindrical portion, a temperature of the first lid, and a temperature of the second lid is lower than the predetermined temperature.

3. The target supply device according to claim 1, wherein the nozzle includes:

a nozzle body formed integrally with the tank;

a nozzle opening for outputting the target material; and a nozzle tip detachably connected to a tip of the nozzle body.

4. The target supply device according to claim 3, wherein:

the nozzle tip is attached to the nozzle body with a nozzle tip coupling member coupled to the tank through the first lid, and the nozzle tip and the nozzle tip coupling member are formed of a material having substantially the same expansion rate as the material of the tank.

5. The target supply device according to claim 4, wherein:

an expansion rate of the second material is greater than an expansion rate of the first material, the first lid is fixed to the cylindrical portion, the second lid is fixed to the tank, and the cylindrical portion is fixed to the second lid such that a space is present between the first lid and the nozzle tip when each of a temperature of the cylindrical portion, a temperature of the first lid, and a temperature of the second lid is at a predetermined temperature that is equal to or higher than a melting point of a target material.

6. The target supply device according to any one of claims 1 through 5, further comprising a thermally conductive member provided between an inner surface of the cylindrical portion and an outer surface of the tank.

* * * * *